US008579116B2

(12) United States Patent
Pether et al.

(10) Patent No.: US 8,579,116 B2
(45) Date of Patent: Nov. 12, 2013

(54) TAMPER EVIDENT DEVICE

(75) Inventors: Fred Pether, New Hope, PA (US); Rich Costa, Bedminster, NJ (US)

(73) Assignee: Oneworld Design and Manufacturing Group, Ltd., Warren, NJ (US)

( * ) Notice: Subject to any disclaimer, the term of this patent is extended or adjusted under 35 U.S.C. 154(b) by 0 days.

(21) Appl. No.: 13/429,635

(22) Filed: Mar. 26, 2012

(65) Prior Publication Data

US 2012/0241451 A1 Sep. 27, 2012

Related U.S. Application Data

(60) Provisional application No. 61/467,030, filed on Mar. 24, 2011.

(51) Int. Cl.
*B65D 83/04* (2006.01)
*B65D 55/06* (2006.01)
*B65D 55/12* (2006.01)

(52) U.S. Cl.
USPC ..... 206/528; 206/531; 206/232; 206/538; 206/532; 206/534; 116/308; 116/309; 116/201; 221/2; 221/4; 221/5; 221/19; 221/25; 221/74; 221/78; 221/89; 221/265; 221/261; 222/362; 222/242; 222/516; 222/185.1; 222/565

(58) Field of Classification Search
USPC ..... 206/232, 531, 538, 533, 534; 221/19, 221/25, 26, 74, 78, 89, 265, 261, 2, 4, 5; 222/362, 242, 185.1, 516, 548, 565; 116/308, 309, 201; 215/230, 228
See application file for complete search history.

(56) References Cited

U.S. PATENT DOCUMENTS

| | | | | | |
|---|---|---|---|---|---|
| 975,681 | A | * | 11/1910 | Ernsberger | 206/533 |
| 2,317,860 | A | * | 4/1943 | Sorensen | 206/531 |
| 2,629,379 | A | * | 2/1953 | Fields | 604/415 |
| 2,975,887 | A | * | 3/1961 | Weingart | 206/533 |
| 3,052,056 | A | * | 9/1962 | Eisenstein | 281/44 |
| 3,076,541 | A | * | 2/1963 | Volckening | 206/232 |
| 3,199,489 | A | * | 8/1965 | Ruoss et al. | 116/308 |
| 3,279,651 | A | * | 10/1966 | Thompson | 221/88 |
| 3,355,067 | A | * | 11/1967 | Espinal | 222/23 |
| 3,393,795 | A | * | 7/1968 | Covert, Jr. | 206/534 |
| 3,561,592 | A | * | 2/1971 | McCool | 206/534 |
| 3,820,654 | A | | 6/1974 | Colella | |
| 3,866,796 | A | * | 2/1975 | Bozek | 221/152 |
| 3,958,690 | A | * | 5/1976 | Gee, Sr. | 206/232 |
| 4,069,942 | A | * | 1/1978 | Marshall et al. | 221/4 |
| 4,083,452 | A | * | 4/1978 | Rossmo | 206/533 |
| 4,298,125 | A | * | 11/1981 | Berghahn et al. | 206/531 |
| 4,424,911 | A | * | 1/1984 | Resnick | 215/365 |
| 4,426,004 | A | | 1/1984 | Hoag | |
| 4,489,834 | A | * | 12/1984 | Thackrey | 206/534 |
| 4,572,376 | A | * | 2/1986 | Wrennall | 206/538 |
| 4,574,954 | A | * | 3/1986 | Reid | 206/531 |
| 4,749,093 | A | * | 6/1988 | Trick | 215/220 |

(Continued)

FOREIGN PATENT DOCUMENTS

WO WO 9406706 * 3/1994 ..... B65D 83/04

*Primary Examiner* — Mickey Yu
*Assistant Examiner* — Gideon Weinerth
(74) *Attorney, Agent, or Firm* — Mitchell J. Mehlman, Esq.

(57) ABSTRACT

Tamper evident devices and methods including devices that can be used with pill bottles and other packages to provide evidence of tampering by an unauthorized user are provided.

8 Claims, 3 Drawing Sheets

(56) References Cited

U.S. PATENT DOCUMENTS

| | | | | | |
|---|---|---|---|---|---|
| 4,778,054 | A | * | 10/1988 | Newell et al. | 206/531 |
| 4,778,070 | A | | 10/1988 | Walker | |
| 4,889,236 | A | * | 12/1989 | Bartell et al. | 206/531 |
| 4,913,083 | A | * | 4/1990 | Valvo et al. | 116/308 |
| 5,110,007 | A | * | 5/1992 | Law et al. | 221/25 |
| 5,322,166 | A | * | 6/1994 | Crowther | 206/538 |
| 5,356,012 | A | * | 10/1994 | Tang et al. | 206/534 |
| 5,464,118 | A | * | 11/1995 | Grau et al. | 221/5 |
| 5,520,307 | A | * | 5/1996 | Miller et al. | 221/2 |
| 5,575,392 | A | * | 11/1996 | Cutler | 206/534 |
| 5,732,836 | A | * | 3/1998 | Barker et al. | 215/230 |
| 5,762,199 | A | * | 6/1998 | Aguilera | 206/533 |
| 5,765,706 | A | * | 6/1998 | Barker et al. | 215/230 |
| 5,782,359 | A | * | 7/1998 | McAllister et al. | 206/538 |
| 5,799,821 | A | * | 9/1998 | Lambelet et al. | 221/5 |
| 5,837,462 | A | * | 11/1998 | Beckers et al. | 435/6.13 |
| 5,921,395 | A | * | 7/1999 | Alexander | 206/538 |
| 5,967,350 | A | * | 10/1999 | Jones | 215/222 |
| 5,979,698 | A | * | 11/1999 | Deal | 221/2 |
| 6,062,420 | A | * | 5/2000 | Krouwel et al. | 221/5 |
| 6,098,835 | A | * | 8/2000 | DeJonge | 221/25 |
| 6,502,717 | B1 | * | 1/2003 | Wolfe | 221/25 |
| 6,545,592 | B2 | * | 4/2003 | Weiner | 368/10 |
| 6,669,022 | B2 | * | 12/2003 | Donegan | 206/531 |
| 6,902,197 | B2 | * | 6/2005 | Vijuk et al. | 283/67 |
| 6,910,718 | B2 | * | 6/2005 | Chareas et al. | 281/44 |
| 7,000,791 | B2 | * | 2/2006 | Miller | 215/230 |
| 7,147,127 | B2 | * | 12/2006 | Lepke et al. | 221/4 |
| 7,398,999 | B2 | * | 7/2008 | Kaufman | 283/81 |
| 7,878,350 | B2 | * | 2/2011 | Ramoundos | 215/230 |
| 7,975,862 | B2 | * | 7/2011 | Gnepper | 215/224 |
| D645,093 | S | * | 9/2011 | Manko | D20/27 |
| 8,201,691 | B1 | * | 6/2012 | Chowdhury | 206/534 |
| 8,327,847 | B2 | * | 12/2012 | Scarrott | 128/205.23 |
| 8,434,421 | B2 | * | 5/2013 | Fagan | 116/309 |
| 2003/0111479 | A1 | * | 6/2003 | Taneja et al. | 221/25 |
| 2004/0026422 | A1 | * | 2/2004 | Westphal | 220/277 |
| 2005/0269237 | A1 | * | 12/2005 | Tung et al. | 206/534 |
| 2006/0124658 | A1 | * | 6/2006 | Coe et al. | 221/121 |
| 2006/0163267 | A1 | * | 7/2006 | Lapsker | 221/2 |
| 2007/0261985 | A1 | * | 11/2007 | Allen | 206/538 |
| 2008/0017602 | A1 | * | 1/2008 | Adler et al. | 215/230 |
| 2008/0238080 | A1 | * | 10/2008 | Brodie | 281/15.1 |
| 2008/0308033 | A1 | * | 12/2008 | Cirrincione | 116/321 |
| 2009/0127157 | A1 | * | 5/2009 | Costa et al. | 206/534 |
| 2009/0255897 | A1 | * | 10/2009 | Buczkowski | 215/230 |
| 2009/0283538 | A1 | * | 11/2009 | Collins et al. | 221/1 |
| 2013/0116818 | A1 | * | 5/2013 | Hamilton | 700/236 |

* cited by examiner

TAMPER EVIDENT DEVICE

CROSS-REFERENCE TO RELATED APPLICATION

This application claims priority of U.S. Provisional Application Ser. No. 61/467,030, titled "Apparatus for providing tamper evidence in medicine packaging", filed Mar. 24, 2011, the disclosure of which is incorporated herein by reference in its entirety.

BACKGROUND OF THE INVENTION

There is a serious and fast growing worldwide problem related to abuse of prescription drugs. In particular, unauthorized persons may remove drugs, often addictive narcotics, from prescription bottles in the home or elsewhere such medications are found.

According to the Los Angeles Times, drug deaths now outnumber traffic fatalities in the United States. Recent analysis of government data has found drugs exceeded motor vehicle accidents as a cause of death in the United States, killing at least 37,485 people nationwide.

While most major causes of preventable death are declining, drugs are an exception. The death toll has doubled in the last decade, now claiming a life every 14 minutes. By contrast, traffic accidents have been dropping for decades because of huge investments in auto safety. Public health experts have used the comparison to draw attention to the nation's growing prescription drug problem, which they characterize as an epidemic.

Fueling the surge in deaths are prescription pain and anxiety drugs that are potent, highly addictive, and especially dangerous when combined with one another or with other drugs or alcohol. Among the most commonly abused are OxyContin, Vicodin, Xanax and Soma. One relative newcomer is fentanyl, a painkiller that comes in the form of patches and lollipops and can be about 100 times more powerful than morphine. Such drugs now cause more deaths than heroin and cocaine combined. See http://articles.latimes.com/2011/sep/17/local/la-me-drugs-epidemic-20110918.

The present invention relates to tamper evident devices and methods that do not restrict access by the authorized user to a medicine package or bottle containing pills or medication. For example, a combination lock restricts access if the authorized user forgets the combination. Likewise, a lock and key locks out the authorized user if the authorized user looses the key. Further, combination lock solutions allow any unauthorized user to try every possibility until finding the right combination.

The present invention records almost all illegitimate attempts to access a package or container utilizing the devices disclosed herein. Further, the present invention can be incorporated or used with almost any pill container or medicine package.

Some devices described as tamper-evident can be more correctly called tamper-resistant because they make a package more difficult to open for both the authorized user and the unauthorized user.

There are many types of containers on the market. Some of these are intended for medicines and the like. Because of the danger of an unauthorized person such as a child, or an unauthorized person seeking narcotics, taking a medicine, manufacturers have designed some bottle caps which are difficult to remove. However, this approach does not prevent the possibility of an unauthorized user opening the bottle and removing or tampering with the contents.

Some of these medicine bottles are claimed to be tamper-proof and achieve this alleged claim by having outer seals around the neck and cap. Some containers claim to be are tamper-evident. These are often quite complicated or bulky.

One such container is shown in Hoag, U.S. Pat. No. 4,426,004, which discloses a tamper-evident container that completely encloses a medicine bottle. Two box-like portions are connected by frangible portions. To access the bottle, the box-like portions are broken apart. Colella, U.S. Pat. No. 3,820,654, discloses a safety container which uses a key to open the container. Walker, U.S. Pat. No. 4,778,070, discloses a tamper-evident bottle cap having frangible pins.

Many of the drugs abused are narcotic pain killers. Thus, patients suffering from severe pain have little tolerance for a package that is difficult to open or has a locking mechanism as discussed above.

Many people take one or more medications, several times a day to maintain or improve their health. Often, these medications or supplements must be taken at specific times each day. If medications or supplements are not available to be taken at the proper times, individual health may be jeopardized.

For example, failure to take a prescribed medication for treatment of chronic pain can result in severe health consequences such as severe pain or withdrawal.

Non-compliance with a prescribed regimen of one or more medications, particularly in the elderly and the aging population of "baby boomers", can result in billions of dollars of unnecessary health care costs.

Further, it can be extremely difficult to monitor tampering with multiple medication schedules. Failure to properly monitor tampering can result in catastrophic health consequences to the patient and high levels of care taker anxiety, which can also lead to increased health problems for care takers.

Known medicine tamper-evident systems have severe limitations. One such limitation is that the authorized user may be prevented from taking their medicine. Another such limitation is the inability for an authorized user or a care taker to track whether someone other than the authorized user is taking medication.

The present invention solves these difficult problems in a novel manner. As such, this invention makes it more difficult for prescription drug abusers to take medicine from family members or other persons without being detected.

Novel tamper evident devices and methods for monitoring and improving authorized users' knowledge of tampering are disclosed herein.

SUMMARY OF THE INVENTION

In a tamper evident device according to one aspect of the invention an apparatus for providing tamper evidence comprises a lid. The lid has an outer surface and an inner surface. The lid has an aperture for viewing through the outer surface and the inner surface. The inner surface has at least one post.

The device includes a middle liner. The middle liner has a plurality of perforated tabs. The device has a spring that can be mounted between the lid and the middle liner thereby allowing the lid to rotate and allowing the at least one post to puncture at least one of the plurality of perforated tabs when the lid is depressed by on or more users.

The device also includes an outer liner. The outer liner has a top surface and a central depression. The top surface has a plurality of indicia corresponding to the plurality of perforated tabs. The central depression engages the middle liner so that the indicia are visible to a user through the aperture and the plurality of indicia can be aligned with the plurality of perforated tabs.

One embodiment of this aspect further includes a bottle. The bottle has a mouth, wherein the outer liner, the middle liner, the spring and the lid are nested to form a locking unit for engaging the mouth. The lid is rotatably mounted to allow a user to select at least one of a plurality of indicia and to puncture at least one of a plurality of perforated tabs associated with the plurality of indicia.

In some embodiments, the lid is substantially circular.

In other embodiments, the outer liner includes twelve indicia corresponding to the months in a year.

In certain embodiments, the indicia are January, February, March, April, May, June, July, August, September, October, November and December.

In other embodiments, the outer liner includes thirty one indicia.

In some embodiments, the indicia are the numbers one (1) through thirty-one (31).

In certain embodiments, the device further includes a retractable user diary for a user to log when the bottle was accessed and to prevent unauthorized entry. In these embodiments, the patient or user can open a retractable diary to initial or sign for a particular day or medicine dose. Absence of a signature or a fraudulent signature can indicate tampering. The diary can add another layer of tamper evidence to further protect the authorized user.

In another aspect of the present invention a method of providing tamper evidence comprises selecting a key indicia. An authorized user rotates an apparatus having a lid. The lid has an aperture and a post wherein the key indicia is visible through the aperture.

When a user depresses the lid, the post punctures one of a plurality of perforated tabs corresponding to the key indicia and engages a middle liner and an outer liner.

The user can rotate the outer lid, middle liner and outer liner as a unit, thereby removing the apparatus from a bottle.

The user can inspect the plurality of perforated tabs, wherein the puncture of any tab other than the tab corresponding to the user selected key indicia is evidence of tampering.

In one embodiment of this aspect, the key indicia is one of the months of the year.

In certain embodiments, the key indicia is one of January, February, March, April, May, June, July, August, September, October, November or December.

In other embodiments, the outer liner has thirty-one (31) indicia.

In some embodiments, the key indicia is one of the numbers from one (1) through thirty-one (31).

In some embodiments, the outer lid, middle liner and outer liner are rotated counter-clockwise thereby threadably disengaging the device from a bottle.

In another aspect of the invention, an apparatus comprises an outer liner. The outer liner includes a depression and a plurality of indicia for identification of an access code.

The device has a middle liner. The middle liner includes a plurality of removable tabs and a depression. The middle liner can be configured to nest within the depression in the outer liner.

A lid has a top surface, a bottom surface, a window, and a post protruding from the bottom surface. The post can be rotatably aligned with any one of said plurality of indicia, thereby aligning the post to puncture any one of a plurality of perforated tabs.

A spring can be positioned between the inner surface of the lid and the depression in the middle liner to allow for movement of the outer lid between a first position and a second position.

A user can rotate the outer lid to view an indicia, depress the lid thereby causing the post to damage at least one of said plurality of perforated tabs being aligned with at least one of said plurality of indicia. An authorized user can inspect the device to determine whether a known perforated tab associated with key indicia has been damaged or whether a perforated tab not associated with the user defined indicia has been damaged.

Some embodiments can further include a medicine container having an aperture. The outer liner can be removabley connected to the bottle thereby covering or uncovering the aperture.

In certain embodiments, the outer liner, the inner liner, the spring, and the lid are assembled together such that attempting to separate or disassemble the outer liner, the inner liner, the spring, or the lid causes permanent irreparable damage to the apparatus.

In certain embodiments, the apparatus further includes a retractable diary.

In other embodiments, outer liner includes an internal screw thread for attachment to a medicine bottle.

In some embodiments, the bottle is a NEXTBOTTLE™ pill bottle.

In some embodiments, the plurality of indicia can include January, February, March, April, May, June, July, August, September, October, November and December.

DETAILED DESCRIPTION

As used herein, the terms medicine, pill and pills refer to any size or shape of a capsule, caplet, granule, tablet, lozenge, or other dosage form typically used for oral or nasal administration of a medication or dietary supplement or for rectal administration in the form of a suppository.

The terms medicine, pill and pills may also include delivery forms typically used for topical administration, such as encapsulated and packaged liquid suspensions or emulsions, powders, creams, salves, serums, ointments and the like. The terms pill, medicine or medication may be singular or plural.

As used herein, the terms medicine and medicines refer generally to prescription and over-the-counter medications, dietary supplements such as vitamins, minerals, or cosmetic products. Further, the terms medicine and medicines refer to any product in pill form which the user has a need or desire to use and to protect against unauthorized use or recognize when unauthorized use has occurred.

As used herein, the term indicia is used to describe an indicator or indicators and may be singular or plural.

Figure 1:
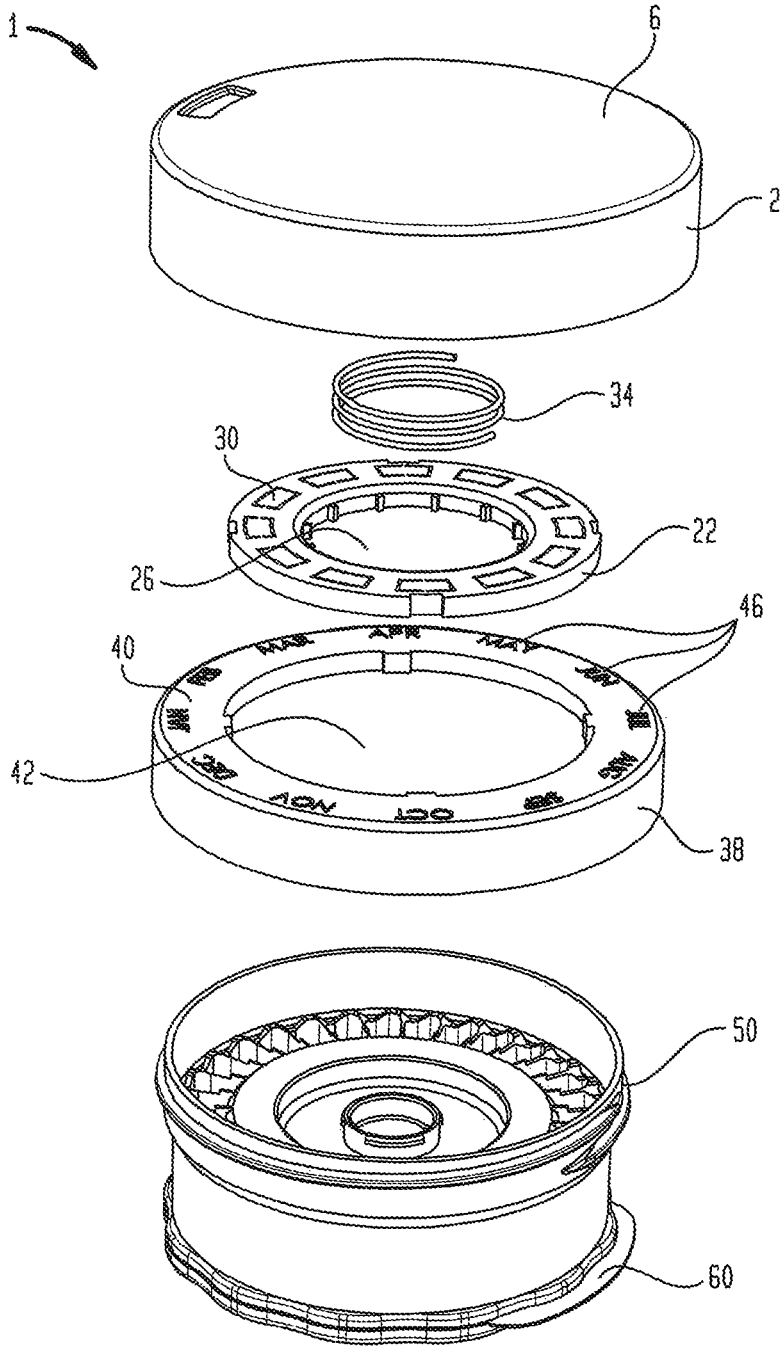
FIG. 1 is a perspective view of a tamper evident device according to one embodiment of the present invention.
Figure 2:
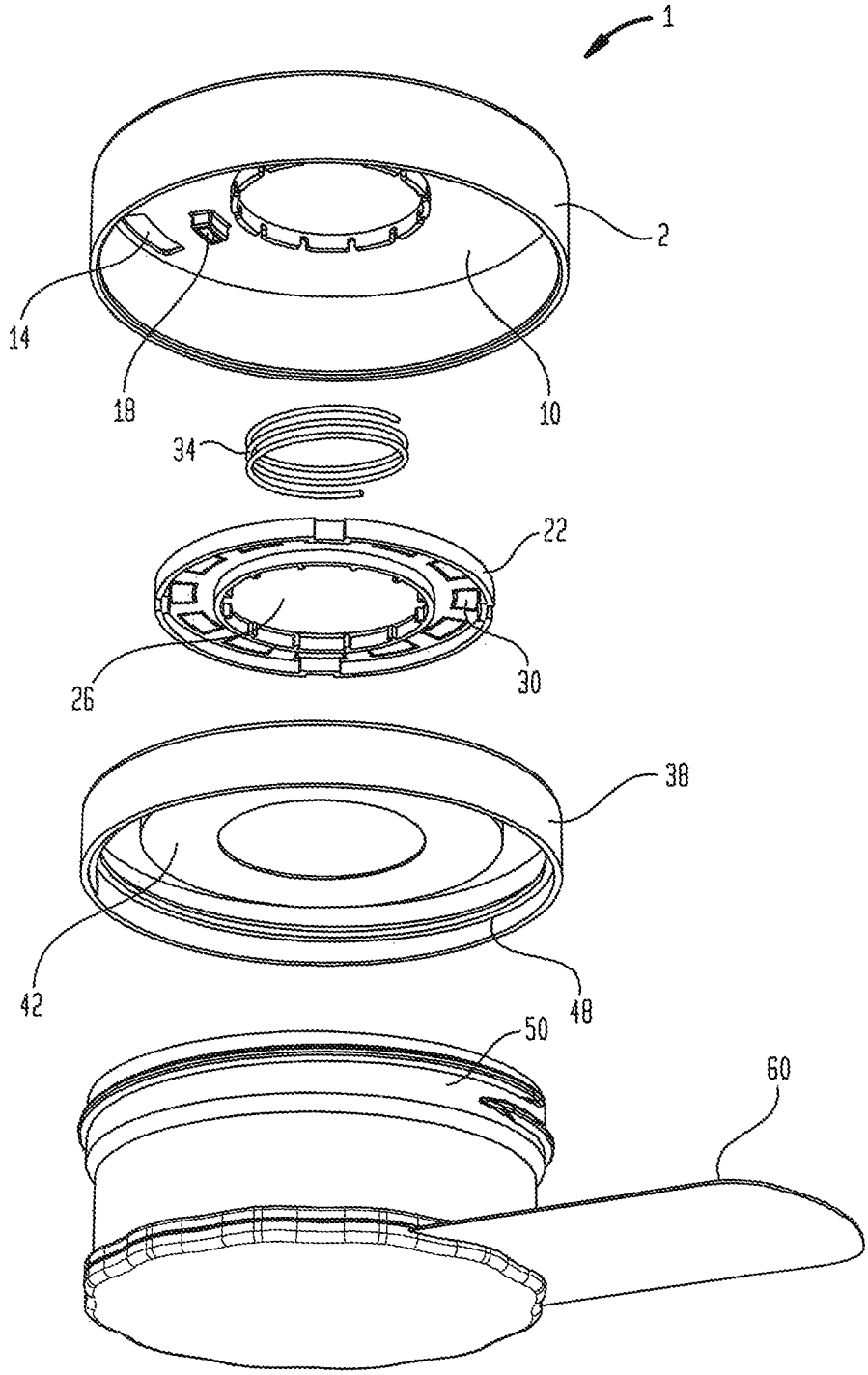
FIG. 2 is a perspective view of some of the elements included in the device of FIG. 1.

As shown in FIGS. 1-2, device 1 in accordance with one embodiment of the present invention includes lid 2 having an outer surface 6 and an inner surface 10. Lid 2 includes aperture 14 for viewing through the lid in a select area or window as will be discussed below. Inner surface 10 of lid 2 includes post 18. Lid 2 can be fabricated from plastics or other structural materials which will be well known to one skilled in the art of packaging or manufacturing.

Middle liner 22 comprises a circular ring having a central depression 26 and circumferentially mounted tabs 30. The tabs are perforated and can be damaged or knocked out when engaged by post 18 on lid 2. Middle liner 22 is rotatably mounted within device 1. In this embodiment, middle line 22 is circularly shaped and includes twelve (12) "monthly" perforated tabs which align with 12 corresponding indicia. Other geometries and middle liner configurations are contemplated within the scope of the present invention.

If desired, to facilitate recognition, tabs 30 may be color coded, for example, to indicate a first color for a first month, a second color for a second month or a different color for each of the 12 months. Middle liner 22 may be molded or fabricated from any suitable structural material. An injection molded polymeric material is preferred.

In this particular embodiment, the device 1 is designed to include a choice of 12 months. In this way, the authorized user will select one of 12 choices before opening the medicine bottle as discussed below.

Spring 34 is mounted between bottom surface 10 of lid 2 and depression 26 of the middle liner. Spring 34 is mechanically captured such that in a user can depress lid 2 thereby engaging post 18 with a corresponding perforated tab 30 to provide evidence of use by an authorized user or tampering, that is, use by an unauthorized user. Spring 34 can be fabricated using any suitable spring material, preferably metal, optionally stainless steel.

Outer liner 38 includes a top surface 40, central depression 42, screw threads 48 for engaging a bottle, and a plurality of indicia 46. Outer liner 38 is sized so that middle liner 22 will fit snugly within central depression 42 and the perimeter of the outer liner will fit snugly within lid 2.

In this embodiment, outer liner 38 can be made from a transparent or translucent polymer material having the 12 months of the year printed thereon as shown in FIGS. 1-2. In this embodiment, the outer liner includes screw threads 48 that engage a bottle. The bottle is preferably a NEXTBOTTLE™ pill bottle as depicted in FIGS. 1-2 but may be any type of container or bottle.

The lid, spring, middle liner, and outer liner are capable of being nested together to form a tamper-proof assembly. In one embodiment, these elements comprise a snap fit assembly. The snap fit assembly is designed in a way such that it is not possible to separate or disassemble the lid, spring, middle liner or outer liner without destroying one or more of these elements.

In operation, the lid is free to rotate in either direction while the middle liner and outer liner are connected to one another such that they move as a single unit. The spring serves to lift the lid and the post above the perforated tabs in a decompressed or storage condition.

Figure 3:
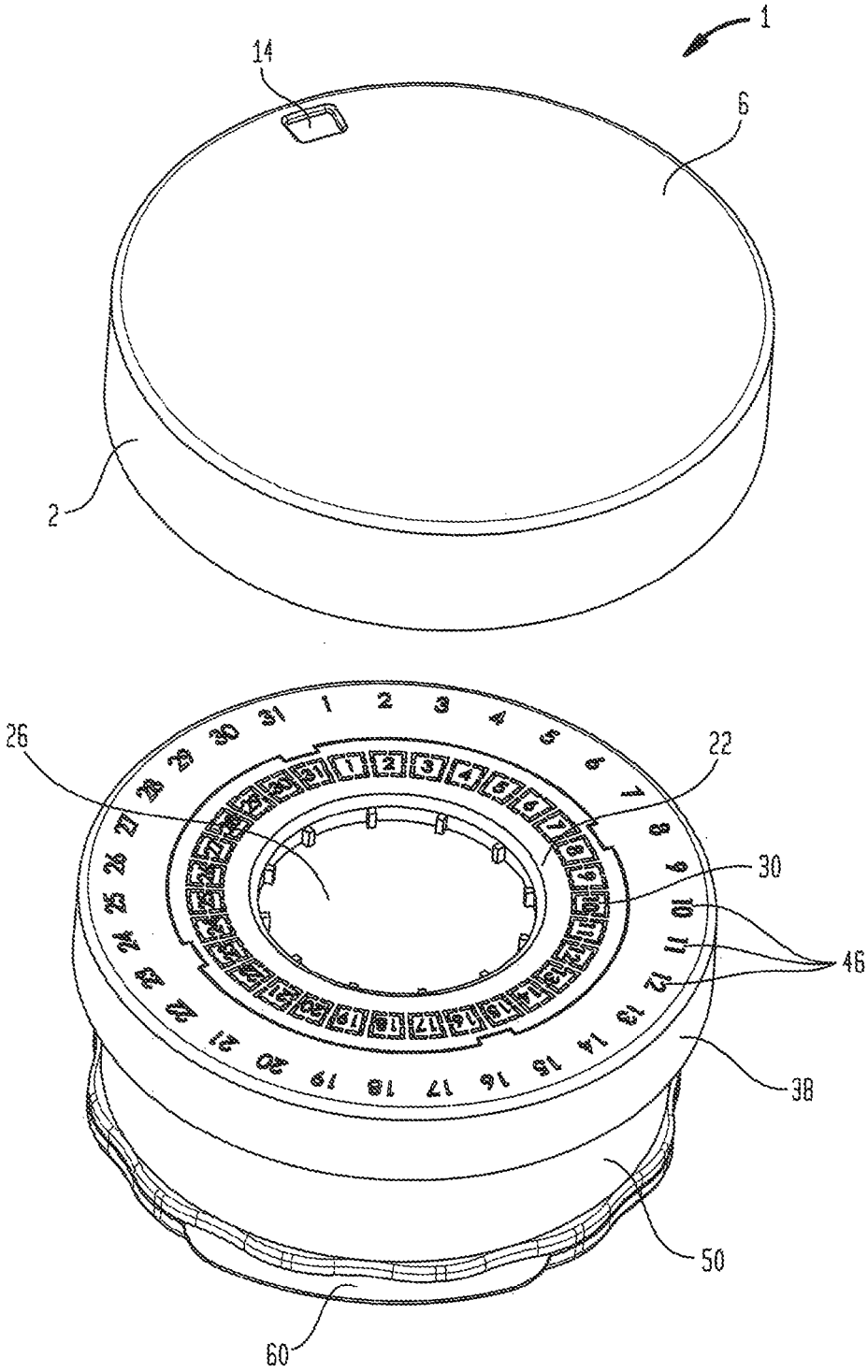
FIG. 3 depicts a perspective view of one embodiment of a tamper evident device.

As discussed above, the device can be attached by threads or screws to a bottle 50 or medicine container, for example, a NEXTBOTTLE™ pill bottle as depicted in FIGS. 1-3. A retractable patient diary 60 can be attached to the device by any known means, for example, as shown in FIGS. 1-3, the diary 60 can be attached to the bottom portion of a pill bottle 50 to allow a user to open the diary 60 as shown in FIG. 2 to make an entry or retract the diary 60 as shown in FIG. 3 to minimize the space required for storage of the device.

User Example.

An authorized user will notice or be instructed that the lid is capable of rotating freely in either direction. As the lid is rotated, the user will see that a plurality of indicia, here, the months of the year, are visible through aperture 14. The authorized user mentally selects one of the available indicia, such as a month of the year having personal significance, for example, March if the user's birthday is in March. The selection can be a month that has particular significance to the user or a random selection of any month.

Having selecting the key indicia, March, for example, the lid is rotated until March appears in the aperture 14. Next, the user depresses the lid 2 with sufficient force, thereby compressing the spring and causing the post 18 to rupture or damage the perforated tab 30 in the middle liner that corresponds with the month of March.

It is important to recognize that while the lid 2 is depressed, the lid can be rotated in a counterclockwise direction. In this position, the post 18 engages the middle liner 22 thus allowing the middle liner, outer liner 38 and lid 2 to be unscrewed from the bottle 50. Next the user can access the contents of the bottle. Unless the lid is depressed, which causes at least one tab to be damaged or punctured, the bottle cannot be opened by ordinary means. Further, as discussed above, attempting to disassemble the device will cause recognizable damage, which is also evidence of tampering.

When the user accesses the contents of the bottle, inspection of the under-side of the device will enable the user to see that only one perforated tab, the one corresponding to March, has been damaged or punctured. If an authorized user opens the bottle and determines that one or more of the perforated tabs 30, other than the tab corresponding to March, has been compromised or perforated, the authorized user is provided with clear, unequivocal evidence that someone other than the authorized user has attempted to access the bottle.

Monitoring and Compliance.

When the device 1 is replaced on the bottle 50, and turned clockwise to seal the bottle, the user turns the lid to a position other than the key position, in this example, March.

Each time the authorized user desires to access medication and needs to open the bottle 50, the user sets the lid to display any one of the plurality of indicia 46, here, the key indicia, March, through the aperture 14. In this way, no other tabs 30 in middle liner 22 will be damaged or compromised by the authorized user.

For each subsequent use of the medication, the process is repeated, thus the user can observe whether any tab 30 other than the tab corresponding with the indicia has been compromised, which would indicate clearly to the authorized user that someone other that the user has attempted to or has actually accessed the bottle.

In this embodiment, an unauthorized user will have a 91.67% chance of being detected. That is, 11 of 12 aperture positions will result in damage to a tab not associated with the key indicia, and are thus unauthorized. Further, if the user makes a mistake and punctures another indicia, for example April, the device is still quite useful because it still offers an 83.33% chance (10 of 12 positions) of detecting tampering.

Typically, pain medications and narcotics are only dispensed in a 30 day supply. When a patient or authorized user receives a refill, the process begins again. The patient has an opportunity to select another month, for example January, so that an unauthorized user who was able to escape detection the first time is progressively more likely to be revealed with each subsequent refill or change in the key indicia.

In another embodiment, as depicted in FIG. 3, the indicia (46) correspond to the days in a month or thirty-one (31) positions. In this case, the odds of puncturing a tab (30), that does not correspond to a user selected key indicia increase to a 96.77% chance of detection (30 of 31 chances will result in puncture to an unauthorized tab). A mistake in this case causes the probability to decrease to 93.55%, a high probability of detection (29 of 31 chances).

In some embodiments, the lid and middle ring can include a second independently rotating second aperture, a second post, and a second series of perforated tabs. In this embodiment, for example, the first indicia can be the months in a year and the second indicia can be the days in a month. The user can rotate each part of the lid to achieve a key indicia having a month and a day, for example, March 26. The detection rate for this embodiment is 99.73% corresponding to 371 of 372 chances of detection for an unauthorized user.

It is to be understood that the geometry of the present invention is not limited to the specific geometries disclosed herein. Any geometry and components that allow a user to select an indicia, puncture or engage the indicia when opening a medicine container, thus creating a record of the act of opening the container and leaving a plurality of other indicia, which are undamaged such that opening the bottle by an unauthorized user has a high probability of being detected. In its simplest form, the device can have as few as two indicia, whereby increasing the number of indicia, can increase the probability from 50% to greater than 99% that an unauthorized user, without knowledge of the indicia used by the authorized user, will be detected when they access the medicine package.

Further, it is envisioned that the present invention can be used with bottles, blister packs, and a plurality of other containers for medicine or other substance where gathering of evidence of tampering is useful, for example, a container for holding jewelry or precious metals.

Thus, the inventive concept of choosing one alternative from many alternatives based upon indicia having individual significance could be used in other situations where it is not desirable to lock somebody out completely but it is desirable to generate evidence of opening a container by an unauthorized user.

The invention as disclosed herein can be fabricated using well known materials and processes. Preferably, the elements are metallic or molded engineering polymers. Such materials and manufacturing processes, including snap fit assembly design and manufacturing techniques, will be well known to those of ordinary skill in the art of packaging.

Although the invention herein has been described with reference to particular embodiments, it is to be understood that these embodiments are merely illustrative embodiments and that other arrangements may be devised without departing from the spirit and scope of the present invention as defined by the disclosure herein.

What is claimed is:

1. An apparatus comprising:

a. an outer liner, said outer liner including a depression and a plurality of indicia for identification of a key indicia;

b. a middle liner including a plurality of perforated tabs having indicia corresponding with said plurality of indicia of said outer liner, and a depression, said middle liner being configured to nest within said depression in said outer liner;

c. a lid having a top surface, a bottom surface, a window between said top and bottom surfaces, and a post protruding from said bottom surface, wherein said post can be rotatably aligned to puncture any one of said perforated tabs when said lid is depressed;

d. a container having an aperture, said container being removably connected to said outer liner for covering or uncovering said aperture; and e. a spring, said spring being positioned between said inner surface of said lid and said depression in said middle liner to allow for movement of said lid between a plurality of positions;

said outer liner, said inner liner, said spring, and said lid being snap fit together such that attempting to separate or disassemble any one of said outer liner, said middle liner, said spring or said lid causes visible damage to said apparatus, wherein a user can rotate said lid to view any of said plurality of indicia through said window and depress said lid causing said post to damage at least one of said plurality of perforated tabs, thereby confirming that an authorized user has punctured a perforated tab associated with said key indicia or that an unauthorized user has punctured one or more perforated tabs not associated with said key indicia each time said container is opened, wherein each puncture of a perforated tab not associated with said key indicia indicates evidence of tampering.

2. The apparatus of claim 1, further including a retractable patient diary.

3. The apparatus of claim 1, wherein said outer liner includes an internal screw thread for connection to said container.

4. The apparatus of claim 3, wherein said container is a pill bottle.

5. The apparatus of claim 1, wherein said outer liner includes twelve indicia.

6. The apparatus of claim 1, wherein said key indicia is one of January, February, March, April, May, June, July, August, September, October, November or December.

7. The apparatus of claim 1, wherein said outer liner includes thirty one indicia.

8. The apparatus of claim 1, wherein said key indicia is one of the numbers from one through thirty one.

* * * * *